US005564600A

United States Patent [19]

Renault

[11] Patent Number: 5,564,600

[45] Date of Patent: Oct. 15, 1996

[54] MULTIPLE COMPARTMENT DISPENSER FOR STORING AND BLENDING THE CONTENTS

[75] Inventor: Philippe Renault, Paris, France

[73] Assignee: L'Oreal, Paris, France

[21] Appl. No.: 379,601

[22] PCT Filed: Aug. 19, 1993

[86] PCT No.: PCT/FR93/00818

§ 371 Date: Feb. 2, 1995

§ 102(e) Date: Feb. 2, 1995

[87] PCT Pub. No.: WO94/04436

PCT Pub. Date: Mar. 3, 1994

[30] Foreign Application Priority Data

Aug. 20, 1992 [FR] France ..... 92 10167

[51] Int. Cl.[6] ..... B67D 5/56

[52] U.S. Cl. ..... 222/129; 206/221; 215/DIG. 8

[58] Field of Search ..... 222/81, 82, 83, 222/145.1, 145.5, 145.6, 129, 212, 94; 215/DIG. 8; 206/221; 604/82, 83, 84

[56] References Cited

U.S. PATENT DOCUMENTS

| | | | |
|---|---|---|---|
| 3,651,990 | 3/1972 | Cernei | 222/94 |
| 3,802,604 | 4/1974 | Morane et al. | 222/83 |
| 3,924,741 | 12/1975 | Kachur et al. | 206/221 |
| 4,105,142 | 8/1978 | Morris, Jr. | 222/158 |
| 4,757,916 | 7/1988 | Goncalves | 222/83 |
| 4,823,946 | 4/1989 | Stoeffler et al. | 206/221 |
| 4,936,446 | 6/1990 | Lataix | 206/221 |
| 4,982,875 | 1/1991 | Pozzi et al. | 222/83 |
| 5,088,627 | 2/1992 | Musel | 222/145.5 |
| 5,277,303 | 1/1994 | Goyet et al. | 215/DIG. 8 X |
| 5,433,328 | 7/1995 | Baron et al. | 215/DIG. 8 X |
| 5,447,226 | 9/1995 | Laine | 215/DIG. 8 X |

FOREIGN PATENT DOCUMENTS

| | | |
|---|---|---|
| 671037 | 4/1966 | Belgium . |
| 2239390 | 2/1975 | France . |
| 2569666 | 3/1986 | France . |
| 3-72634 | 7/1991 | Japan . |
| 3-72678 | 7/1991 | Japan . |
| 337304 | 5/1959 | Switzerland . |
| 1436648 | 5/1976 | United Kingdom . |

*Primary Examiner*—Andres Kashnikow
*Assistant Examiner*—Kenneth Bomberg
*Attorney, Agent, or Firm*—Staas & Halsey

[57] ABSTRACT

A device for keeping two products in respective containers separate from one another, and for mixing them when desired for use. A seal including a sealing plate is connected to one of the containers, and a closure partition equipped with a seat is connected to the other of the containers. In a closed position, the sealing plate seals against the seat, but a relative translational displacement of the two containers moves the plate away from the seat, opens the seal, increases an internal volume of the assembly of the two containers, and allows the products to mix.

30 Claims, 5 Drawing Sheets

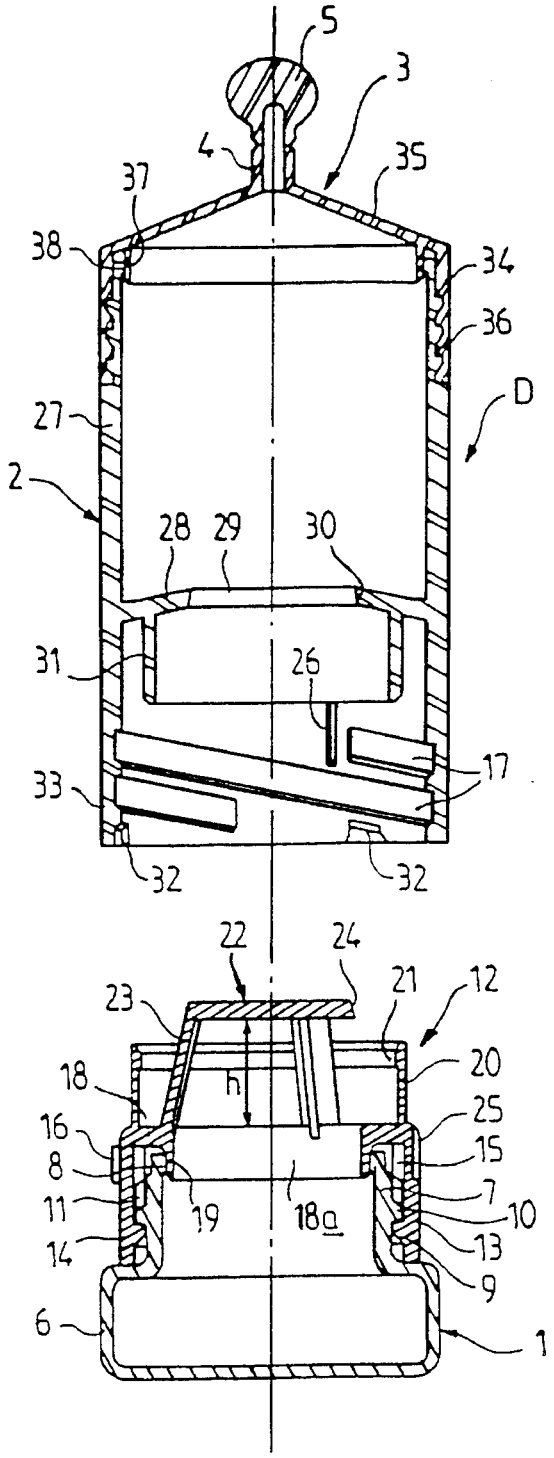
FIG. 1
FIG. 2
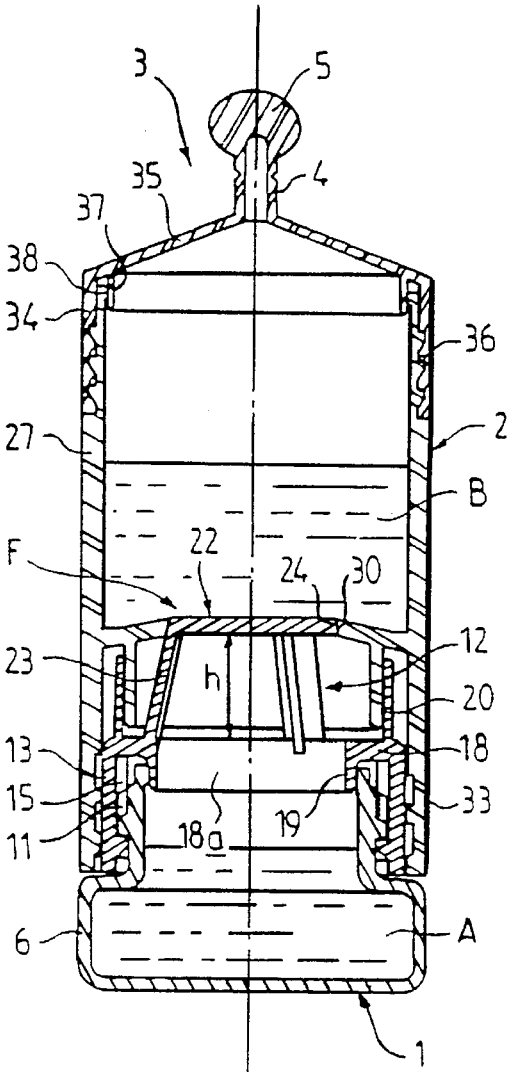
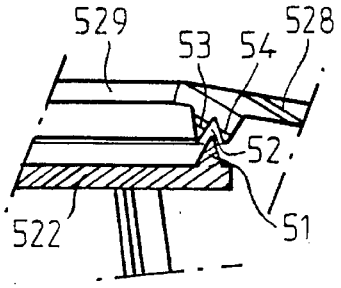
FIG. 13

MULTIPLE COMPARTMENT DISPENSER FOR STORING AND BLENDING THE CONTENTS

1. Background of the Invention

The invention relates to a device for keeping at least two products separate from one another and for blending them at a desired instant, especially at the moment of use, of the type which includes:

a first container for one of the products;

at least one second container for at least one other product, the two containers being assembled to be sealed relative to the exterior, whilst having the capability for relative displacement, and sealing means able to keep the first container isolated from the second one, it being possible for these sealing means to be opened in response to an appropriate relative displacement of the containers.

2. Description of the Related Art

FR-A-2,569,666 shows a device of this sort in which the sealing means comprise an inner seal intended to be torn upon relative displacement of two reservoirs, to bring them into communication. The inner seal, once torn, may hinder the good flow of the products and the blending. What is more, the inner seal is perforated by a relative axial displacement of the reservoirs which causes a decrease in the internal volume of the assembly of the blender. Now, such a device is often used for the purpose of mixing a colorant contained in one of the containers and an oxidizing agent contained in the other container in order to produce a hair dye; when blending is carried out, there is a slight release of gas and the decrease in the internal volume contributes to an increase in overpressure, which may cause the mixture to splash out when the device is opened to the exterior, for the purpose of dispensing this mixture.

The documents JP-U-3-72634 and JP-U-3-72678, published on Jul. 23, 1991, show a device of the sort defined previously in which the sealing means comprise a stopper situated inside the internal volume, and which is detached upon relative displacement of the two reservoirs. The axial displacement of the two containers, allowing the sealing means to be opened, gives rise to an increase in the internal volume of the blender assembly, but the stopper once detached still constitutes a hindrance to the good flow of products or of the mixture either as regards the communication between the two containers, or as regards the orifice allowing the mixture to be dispensed to the exterior.

FR-A-2,239,390 shows a device of the sort defined previously in which the sealing means comprise a sealing plate connected to one of the containers, and a closure partition equipped with a seat for the sealing plate, the assembly being such that, in the closed position, the sealing plate is applied in a sealed manner against the seat, whereas an appropriate relative displacement of the two containers moves the plate away from the seat and opens the sealing means. According to FR-A-2,239,390, the displacement causing the sealing means to open gives rise to a decrease in the internal volume of the assembly, with the drawbacks mentioned previously.

SUMMARY OF THE INVENTION

An object of the invention is to provide a device for keeping at least two products separate from one another, of the sort defined previously, which no longer has the drawbacks recalled hereinabove, or exhibits them to a lesser extent. It is desired in particular for this device, when the sealing means have been opened, to allow good communication between the containers and good flow of the mixture to the exterior, without the sealing means being able to hinder this flow in an uncontrolled manner. It is furthermore desirable for the device to remain simple and economical to manufacture, whilst giving good sealing between the two containers during storage.

It is furthermore desirable for the opening of the sealing means not to be accompanied by a decrease in the internal volume of the assembly of the containers.

According to the invention, a device is provided for keeping at least two products separate from one another and for blending them at a desired instant, especially at the moment of use, of the sort defined previously, in which the sealing means comprise a sealing plate connected to one of the containers, and a closure partition equipped with a seat for the sealing plate, the assembly being such that, in the closed position, the sealing plate is applied in a sealed manner against the seat, whereas an appropriate relative displacement of the two containers moves the plate away from the seat and opens the sealing means. The closure partition with the seat is connected to the other of the containers and the translational displacement between the two containers which causes the sealing means to be opened gives an increase in the internal volume of the assembly of the two containers.

Advantageously, the sealing plate is blocked in rotation and in translation relative to the container to which it is connected.

For preference, the assembly is such that the relative displacement between the two containers includes at least one axial translation component, the opening of the sealing means being caused by the axial translation movement of the sealing plate relative to the seat.

The relative displacement between the two containers may result from the combination of a rotational movement and of a translational movement by means of the interaction of at least one helical ramp secured to one of the two containers with a stub engaged in this ramp and secured to the other container. According to another possibility, the two containers are mounted so as to allow relative sliding therebetween.

In general, the sealing plate is circular and coaxial to the containers.

Advantageously, the sealing plate is carried by at least two tabs extending substantially in the axial direction of the containers, these tabs being secured, at their end remote from the sealing plate, to a base hoop including a central opening.

Preferably the sealing plate has a frustoconical edge able to interact with a corresponding frustoconical seat.

The hoop carrying the sealing plate may form part of an independent piece (or sealing piece) intended to be fixed, especially by snap-fitting, onto the neck of one of the containers. This sealing piece includes an external skirt which surrounds the neck of the container, a sealing lip being designed to interact with the entrance of the neck, anti-rotation catches being provided between the internal face of the skirt and the external surface of the neck.

A system of helical ramps and stubs may be provided between the two containers to cause the relative translational displacement starting from a rotational movement; for preference, the stubs are designed to be secured to the container equipped with the sealing plate, whereas the helical ramps are secured to the other container. Advantageously, the helical ramps are closed at their ends to prevent any detachment due to an excessive rotational movement between the two containers. A means for stopping rotation is advantageously provided between the two containers, this stopping means including a longitudinal catch parallel to the axis of the two containers and provided on the internal surface of one of the containers, this catch being able to interact with a corresponding longitudinal channel provided on the other container or a piece secured to this other container, the interaction being obtained when the assembly is in the closed or storage position.

The hoop secured to the tabs carrying the sealing plate may be provided directly on one of the containers and form a single piece with this container.

At least one of the containers may include a flexible pouch.

One of the two containers is equipped with a means for dispensing the mixture obtained, it being possible for this means to include a nozzle which can be sealed by a stopper.

Apart from the provisions explained hereinabove, the invention includes a certain number of other provisions which will be dealt with more fully hereafter with regard to embodiments described with reference to the drawings appended hereto, but which are in no way limiting.

BRIEF DESCRIPTION OF THE DRAWINGS

FIG. 1 of these drawings shows a device in accordance with the invention, during assembly, in vertical axial section.

FIG. 2 shows the device of FIG. 1 assembled, the sealing plate being in the closed position, each container containing a liquid product.

Finally, FIG. 13 is a partial section on a larger scale of a detail of an alternative embodiment of the sealing plate and of the seat of FIGS. 1 to 4.

DESCRIPTION OF THE PREFERRED EMBODIMENTS

Figure 3:
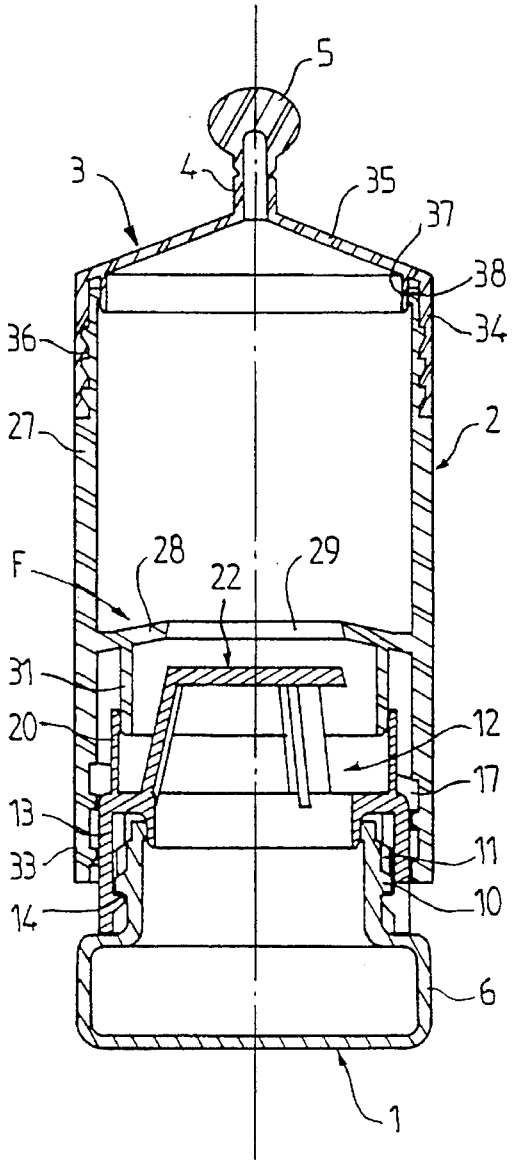
FIG. 3 shows, similarly to FIG. 2, the device with the sealing plate in the open position.

Referring to the drawings, especially to FIGS. 1 and 2, a device D can be seen for keeping two liquid products A, B separate from one another and for blending them at a desired instant, especially at the moment of use. Such a device is particularly suitable for oxidation colorings, the liquid A corresponding to the colorant whilst the liquid B corresponds to the oxidizing agent.

The device D includes a first container 1 for the product A and a second container 2 for the product B; this second container 2 is mounted on the first container 1 so as to be sealed relative to the exterior. Sealing means F able to keep the two containers isolated from one another during storage are further provided.

The second container 2 is equipped at its end remote from the first container 1 with a closure cap 3 equipped with a nozzle 4 closed by a stopper 5 which can be broken or torn off at the moment of use to let the mixture out.

The container 1 includes a body 6, forming a reservoir, made from polyvinyl chloride or glass or coextrusion of HDPE/EVOH/HDPE (high-density polyethylene/ethylene vinyl alcohol/high-density polyethylene) in order to contain the liquid A. The body 6 is equipped with a neck 7, generally cylindrical, with a circular cross-section, the upper end of which is equipped with an internal rim 8 forming a collar. The outer wall of the neck includes, towards the base of the neck, a fastening groove 9 delimited, upwards, by a rib 10 having a cross-section substantially in the shape of a right-angled trapezium. The face of the rib 10 pointing towards the bottom of the container 1 is situated in a plane orthogonal to the axis of the container.

The wall of the neck 7 includes, towards the outside, above the rib 10, teeth 11 which are uniformly distributed about the periphery and point parallel to the axis of the container.

In the embodiment of FIGS. 1 to 4, the sealing means F includes a piece 12, or sealing piece, which is independent of the container 1. The sealing piece 12, made from plastic, includes a cylindrical peripheral skirt 13 able to surround the neck 7 of the container. This skirt 13 includes, on its internal surface, a fastening ring 14 projecting radially inwards and able to fasten behind the rib 10 of the neck. The internal surface of the skirt 13 is further equipped with anti-rotation teeth 15 projecting inwards parallel to the axis of the skirt 13 and able to engage between the teeth 11 of the neck 7. Thus, when the sealing piece 12 is snap-fitted onto the neck 7, it is blocked in rotation and in translation relative to the neck 7 and to the container 1. Translational blocking results from the action of the ring 14 interacting with the rib 10 and from the lower edge of the skirt 13 bearing against the widened wall of the container 1 at the base of the neck 7.

The skirt 13, on its exterior cylindrical surface, includes at least two guide stubs 16 intended to interact with corresponding helical ramps 17 provided at the lower part of the internal surface of the second container 2. The stubs 16 are inclined with the same pitch as the ramps 17. These ramps are closed at their ends (non-emerging ramps).

The skirt 13 includes, above the stubs 16, a hoop 18 whose mean plane is orthogonal to the axis of the skirt, this hoop 18 extending inwards in the radial direction. The internal edge of this hoop is equipped with a sealing lip 19 forming a sort of sleeve which engages in a sealed manner inside the rim 8 of the neck, and which delimits an opening 18*a*.

A cylindrical sleeve 20, with lesser thickness than that of the skirt 13, and also with a smaller outside diameter, extends on the opposite side from the skirt 13, starting from the hoop 18. The sleeve 20 includes, on its internal surface, towards its end remote from the hoop 18, a sealing ring 21 which projects radially inwards.

A sealing plate 22, whose mean plane is orthogonal to the axis of the skirt 13, is carried, at a distance h from the hoop 18, by tabs 23, preferably three in number, uniformly spaced apart. The plate 22 is situated beyond the upper edge of the sleeve 20 and its diameter is less than that of the opening of the hoop 18. The tabs 23 are slightly inclined relative to the axis of the skirt 13 and are secured, at their end remote from the plate 22, to the hoop 18 in the region of the internal edge. The edge 24 of the plate 22 is advantageously frustoconical. The plate 22 has the shape of a circular disc, coaxial with the container 1.

The sealing plate 22 forms a single piece with the hoop 18, the skirt 13 and the sleeve 20. The distance h from the plate 22 to the hoop 18 is sufficient for an annular passage of sufficient cross-sectional area to exist between the plate 22 and the said hoop 18.

The skirt 13 includes, on its outer cylindrical surface, at least one longitudinal channel 25 parallel to the axis of the skirt, able to interact with a catch 26 (see FIG. 1) projecting inwards, provided on the internal surface of the second container 2. The catch 26 has a longitudinal orientation, parallel to the axis of the container 2, in a way similar to the channel 25. The angular positions of the channel 25 and of the catch 26 are chosen such that the catch 26 enters the channel 25 when the sealing plate 22 reaches its closed position. Thus, during storage or during handling of the device D in the closed position, the interaction of the catch 26 and of the channel 25 prevents vibration, especially during transport, from causing relative unscrewing of the two containers 1 and 2 and therefore untimely opening of the sealing plate 22 with undesired communication between the two containers 1 and 2.

Figure 4:
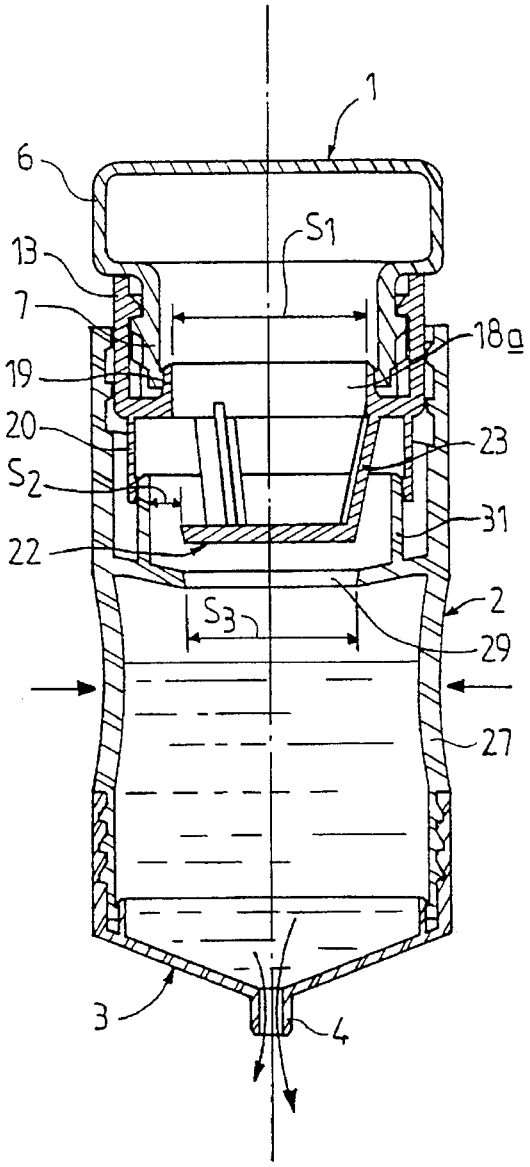
FIG. 4 shows, in vertical section, the use of the device after blending has been achieved, with this mixture flowing out towards the exterior, the device being inverted with the head down.

The second container 2 has a shape which is cylindrical of revolution; its outer wall 27 is preferably flexible so that it can be deformed, as illustrated in FIG. 4, in order to improve discharge of the mixture. In the case of an oxidation dye, where this container 2 contains the oxidizing agent, the container 2 is advantageously made of polypropylene or polyethylene.

The container 2 includes a slightly frustoconical internal partition 28 with its concavity pointing towards the container 1, and constituting a sort, of hoop including, in its central region, an opening forming a seat 29 for the sealing plate 22. An edge 30 of the seat 29 is frustoconical so as to match the edge 24 of the plate 22 in the closed position.

A cylindrical sealing skirt 31 coaxial with the wall 27 extends downwards from the lower face of the partition 28. The diameter of the external surface of this skirt 31 is such that it enters the sealing ring 21 with a certain degree of clamping, as illustrated in FIG. 2, to establish a sliding seal which is maintained throughout the possible displacement between the two containers 1 and 2.

The region of the interior surface of the wall 27 situated below the partition 28 includes the non-emerging helical ramps 17 already mentioned, which in number correspond to the number of stubs 16. The slope of the helix and the length of each ramp are chosen as a function of the amplitude of the desired axial displacement between the two containers 1 and 2 and therefore between the plate 22 and the seat 29 for opening. Small access ramps 32 which in number equal that of the stubs 16 are provided to facilitate the insertion of these stubs 16 into the ramps 17 and thus snap-fit a the base 33 of the container 2 onto the skirt 13 and to allow assembly of the sealing piece 12 and of the container 2 which are positioned in the closed position.

The upper end of the container 2 is equipped with the closure cap 3 including a cylindrical skirt 34 and a frustoconical hat 35 with the nozzle 4 at its tip. A screw thread able to interact with a complementary screw thread 36 provided on the outer surface of the wall 27 of the container 2 is provided on the internal surface of the skirt 34. It is thus possible for an operator to unscrew the cap 3 and withdraw a little oxidizing product B to make a test swab using a separate sample of colorant.

A sealing skirt 37 coaxial with the container 2 extends downwards from the internal face of the frustoconical hat 35 so as to engage, with a slight degree of clamping providing sealing, against a sealing ring 38 provided at the internal border of the upper opening in the wall 27.

The device D may be assembled with the aid of three sub-assemblies including respectively of the container 1, the sealing piece 12 and the container 2 which are snap-fitted in the closed position, and the cap 3.

The container 1 is first of all filled with product A, then the sub-assembly formed by the sealing piece 12 and the container 2 is snap-fitted onto the container 1, the fastening ring 14 of the skirt 13 then fastening behind the rib 10.

The container 2 is then filled with liquid B, then the cap 3 is screwed onto the upper end of the wall 27. The device D in the storage position, containing the products A and B separate from one another is thus obtained.

At the moment of use, when the operator wishes to blend the two products A and B, all he needs to do is take hold of the container 1 in one hand and the wall 27 of the container 2 in the other hand. By imparting a relative rotational movement to the two containers 1 and 2, the operator causes an axial translation of the containers 1 and 2 which move away from one another, so that the sealing plate 22 moves away from the seat: 29 and allows one product to flow into the other for blending.

The sealing piece 12 and the container 2 cannot be separated from one another because the stubs 16 are trapped in the ramps 17 which are closed at each of their ends.

After having effected, for example, a rotation of half a turn between the containers 1 and 2, the operator inverts the device D so that the product contained in the container 1 flows into the container 2 whose volume has been defined to take account of this. The operator then shakes the device D to obtain a homogeneous mixture. After having broken the stopper 5 or end piece, the operator can dispense the mixture by exerting a pressure on the flexible body of the container 2, as illustrated in FIG. 4.

It should be noted that the dimensions of the various elements are chosen, preferably, so as to give substantial equality in the passage cross-sectional area for the mixture at the various points. In particular, the dimensions are chosen so that the cross-sectional area S1 (see FIG. 4) of the opening 18*a* delimited by the sealing lip 19 is substantially equal to the cross-sectional area S2 of the annular passage lying between the edge 24 of the sealing plate 22 in the open position and the internal surface of the skirt 31 and is substantially equal to the passage cross-sectional area S3 of the seat 29.

Figure 5:
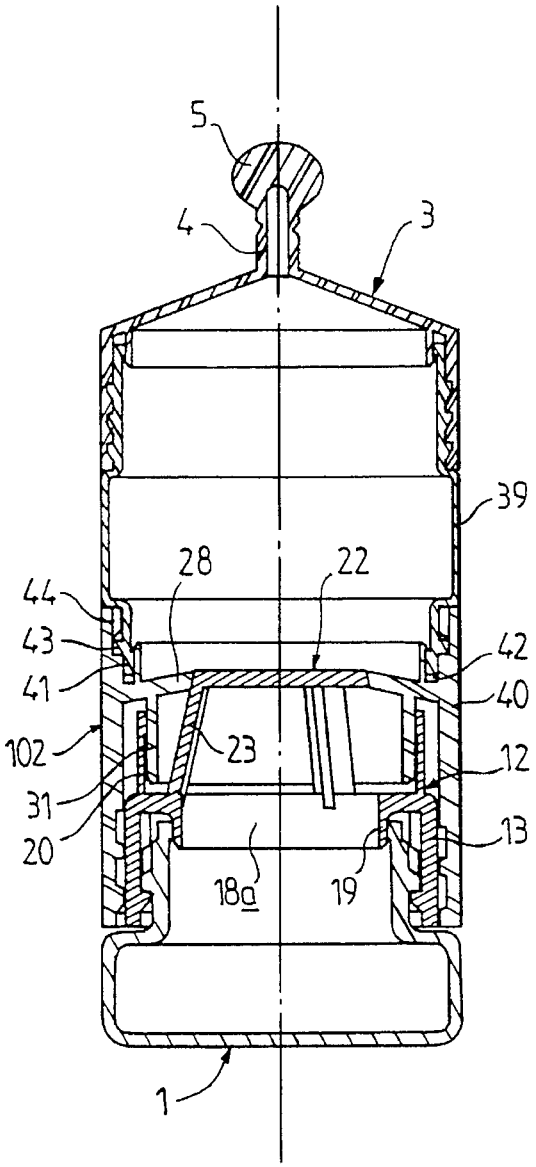
FIG. 5 illustrates, similarly to FIG. 2, an alternative embodiment.

Referring to FIG. 5, an alternative embodiment can be seen which again uses most of the elements already described with regard to the preceding figures and which are denoted by the same numerical references without their description being undertaken again.

To improve the flexibility of the upper container 102, the body 39 is made by injection blow-molding. The lower part 40 of the container 102 constitutes an actual separator and includes the partition 28. This part 40 is fixed in a sealed manner to the base of the body 39. The lower edge 41 of the body 39 is engaged in a groove 42. The lower region of the body 39, which has a smaller diameter, includes on its outer surface a fastening ring 43 which snap-fits behind a fastening rim 44 provided on the inner surface of the part 40.

The assembly and operation of the device illustrated in FIG. 5 are similar to those described previously.

It should be noted that the container 1 could equally well be produced with flexible walls, especially in the case where the products to be blended are intended to produce a permanent wave.

Figure 6:
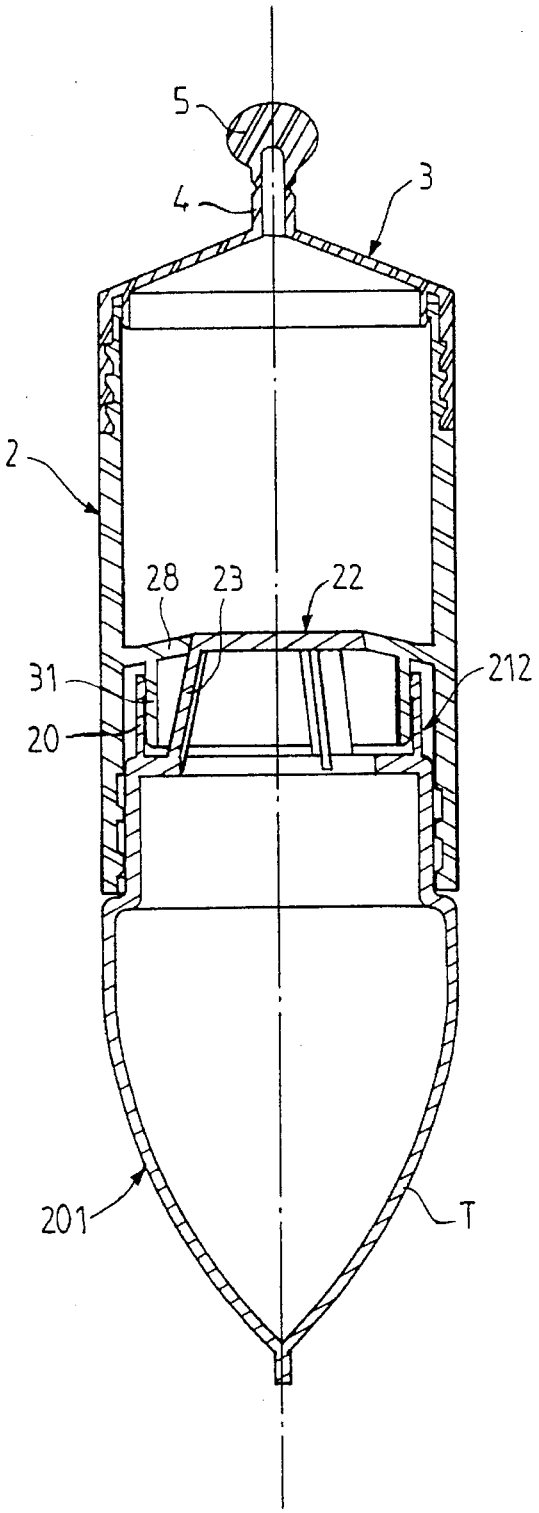
FIG. 6 illustrates, in axial vertical section, another alternative embodiment, in the closed position.
Figure 7:
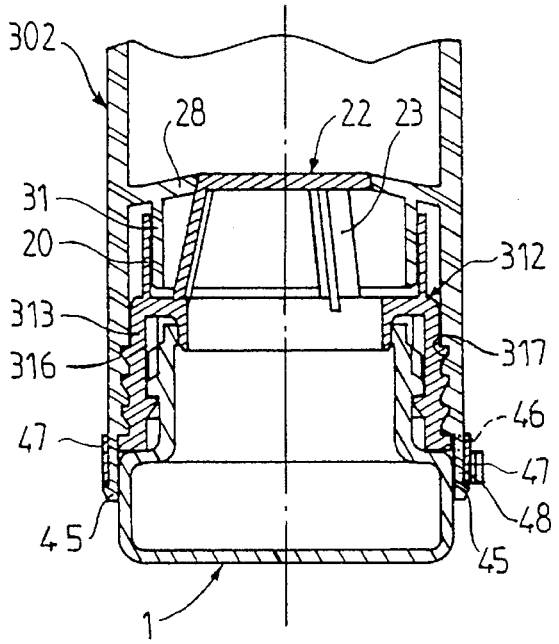
FIGS. 7 and 8 are views in partial axial vertical section of another alternative embodiment.
Figure 8:
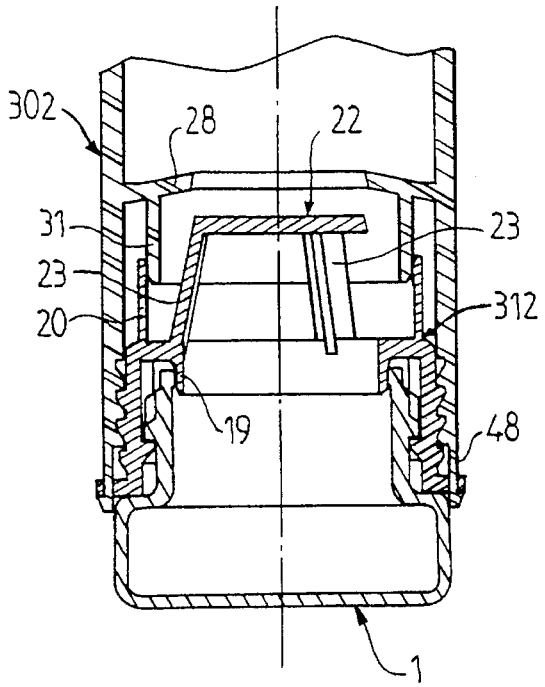

FIG. 6 illustrates another alternative embodiment corresponding to a blending tube version. The container 201 is arranged in the form of a tube T, and the sealing piece 212 forms one and the same piece with this tube T whose head it constitutes. In this case, the device D is composed of just three pieces, namely the lower container 201 with the sealing piece, the upper container 2 and the cap 3.

FIGS. 7 to 10 partially illustrate an alternative embodiment which differs from that of FIGS. 1 to 4 only as regards the ramps 317 of the container 302 and the complementary means provided on the outer surface of the skirt 313.

The ramps 317 include a conventional screw flight instead of non-emerging ramps, as in the case of FIGS. 1 to 4. The skirt 313 is equipped on its outer surface with a screw thread 316 matching the ramps 317.

To prevent the sealing piece 312 from being able to become detached from the container 302 at the end of unscrewing, long hooks 45 projecting radially outwards are provided at the base of the skirt 302 at the end of tabs 48.

Figure 9:
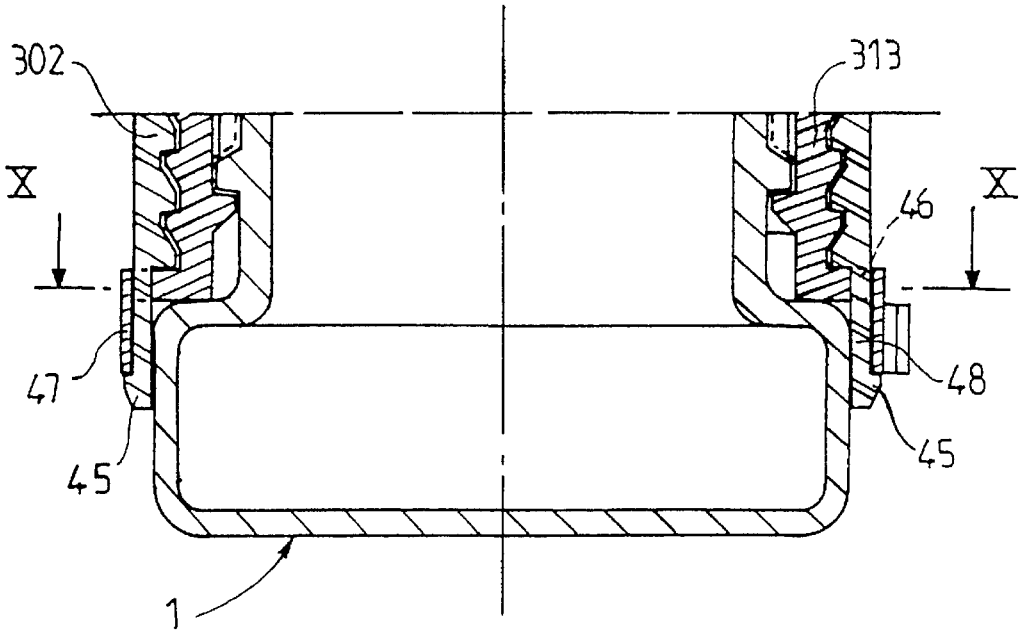
FIG. 9 shows in vertical section, on a larger scale, details of the lower part of the device of FIG. 7.
Figure 10:
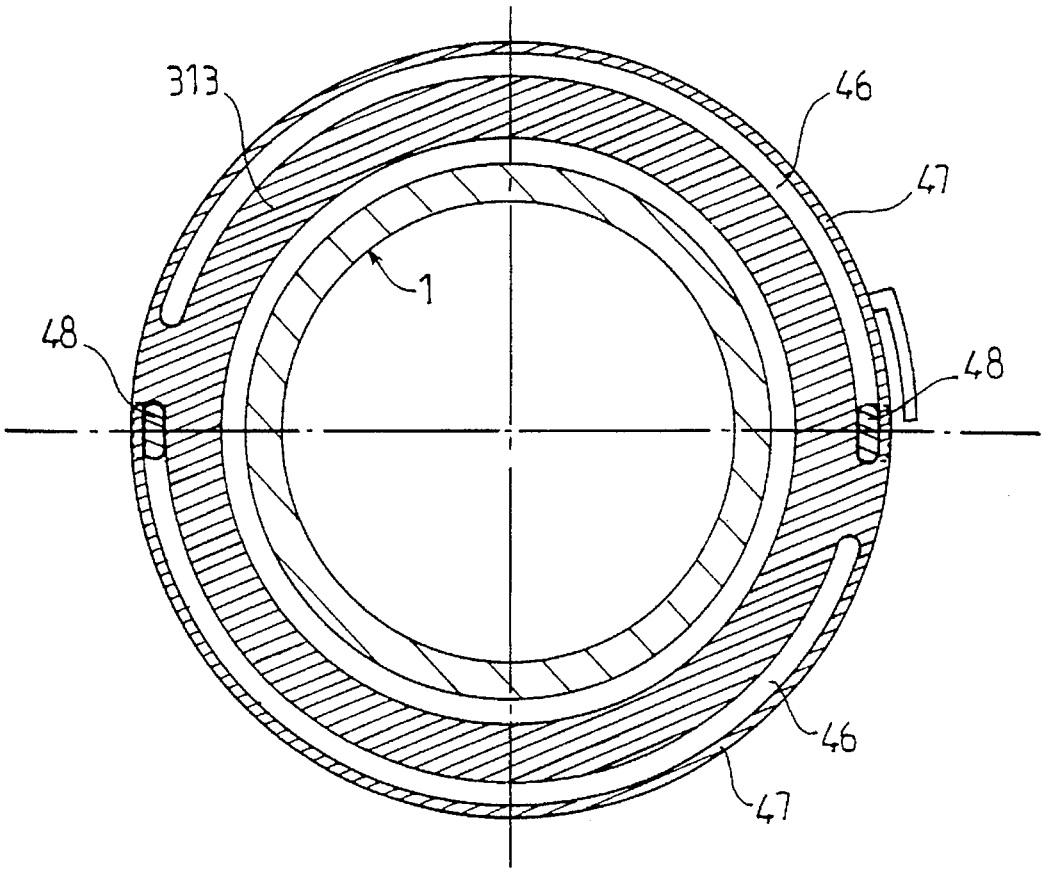
FIG. 10 is a section on the line X—X of FIG. 9.

The two long hooks 45 are inserted (after 302 is screwed onto 312) under a tear-off strip 47 after having passed through two slots 46 in the shape of a circular arc (see FIGS. 9 and 10). The lengths of these slots 46 can vary depending on the rotation which it is desired to obtain for 302.

The height of the tear-off strip 47 is sufficient to allow the relative displacement in vertical translation between the containers 1 and 302 which is necessary to cause suitable communication between these containers.

In the closed position of the sealing plate 22, the long hooks 45 are located under the tear-off strip 47. In order to move the sealing piece 22 off its seat 29, the user must remove the tear-off strip 47 connected to the skirt 313 by a weakened region, which allows the tabs 48 to be fitted into the slots 46.

At the end of unscrewing, the long hooks 45 come to bear against the lower edge of the slots 46, which marks the end of possible unscrewing.

Figure 11:
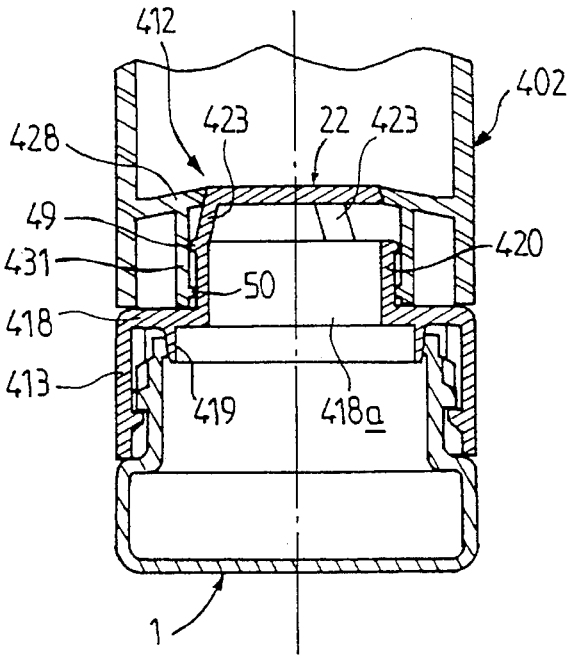
FIGS. 11 and 12 show, similarly to FIGS. 7 and 8, another alternative embodiment respectively with the sealing plate in the closed position and in the open position.
Figure 12:
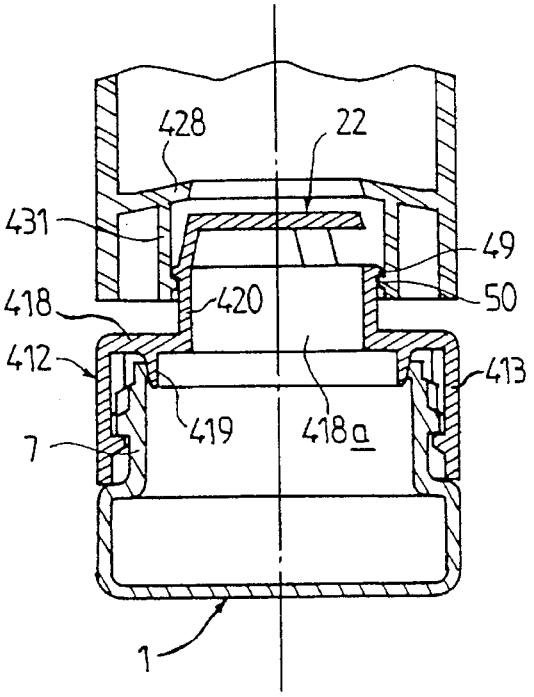

Referring to FIGS. 11 and 12, it is possible to see, represented partially, an alternative embodiment of the "push-pull" type in which the relative displacement between the container 1 and the container 402 can be obtained by a single axial translation movement.

The sealing piece 412, which is still fixed by snap-fitting onto the neck 7 of the container 1, includes a hoop 418 having a central opening **418*a* whose diameter is less than that of a lip 419. A sleeve 420 is secured to the internal edge of the hoop 418 and extends in the axial direction on the opposite side to a skirt 413. The upper edge of this sleeve 420 is secured to the tabs 423 carrying the plate 22**.

The sleeve 420 is capable of displacement inside a skirt 431 secured to the partition 428 of the second container 402. A peripheral bead 49 is provided on the outer surface of the sleeve 420 so as to rub against the internal surface of the skirt 431.

An internal bead 50 is provided on the internal surface of the skirt 431 close to its lower end. This bead 50 rubs in a sealed manner against the outer surface of the sleeve 420.

The beads 49 and 50 are able to come to bear against one another to mark the end of the translational movement permitted between the container 402 and the container 1, as illustrated in FIG. 12.

In the embodiment of FIGS. 11 and 12, the container 402 and the sealing piece 412 are free not only in translation but also in rotation.

It is possible to provide relative blocking in rotation of the two elements with the aid of non-emerging ramps parallel to the axis of the containers; these ramps would be provided, for example, on the container 402 to interact with corresponding stubs provided on the container 1 or the sealing piece 412. In the latter case, just an axial translation movement would be allowed, the interaction of the ramps and of the stubs preventing the rotational movement.

FIG. 13 illustrates an alternative embodiment of the sealing plate 522 and of the opening 529 of FIGS. 1 to 4.

The sealing plate 522 is equipped on its upper face with a peripheral rib 51 projecting upwards, in the form of a hoop of triangular cross-section. The rib 51 extends right around the sealing piece 522, slightly set back from the edge.

An internal partition 528 is equipped on its lower face with a groove 52 whose cross-section complements the rib 51. This groove 52 is delimited by two skirts 53, 54 projecting downwards. The skirts 53, 54 include hoops with triangular cross-section which are situated slightly on the outside, in the radial direction, of the edge of the opening 529. By axial translation movement, the rib 51 can be applied into the groove 52 in a sealed manner.

In FIG. 13, the rib 51 has been represented slightly away from the groove 52.

Regardless of the embodiment alternative, the invention makes it possible to blend the two products under good conditions, without the sealing piece; fixed to one of the containers or to a piece secured to one of the containers hindering the blending in an uncontrolled manner.

I claim:

1. Device for keeping at least two products separate from one another and for blending them when desired, comprising:

a first container for one of the products, said first container including a neck, at least one second container for at least one other of the products, the first and second containers forming an assembly which is sealed relative to an exterior of the containers, this second container being equipped with a cap which can be removed to let the mixture out, and sealing means for keeping the first container isolated from the second container, said sealing means being openable in response to relative displacement of the containers, and having:

a sealing piece including a peripheral skirt surrounding the neck of the first container, this skirt including a hoop extending radially therefrom and a cylindrical sleeve which extends from the hoop and which has an outside diameter smaller than an outside diameter of the skirt, and a sealing plate spaced from the hoop, and a closure partition equipped with a seat for the sealing plate and connected to the second container, the assembly being such that, in a closed position, the sealing plate seals against the seat, whereas a relative translational displacement of the two containers moves the plate away from the seat to open the sealing means, and increases an internal volume of the assembly of the two containers, to form an open position, wherein the sleeve is on an opposite side from the skirt relative to the hoop, the closure partition includes in a central region thereof, an opening forming the seat for the sealing plate, a cylindrical sealing skirt extends downwards from a lower face of the closure partition in order to interact with the cylindrical sleeve, and an annular passage is formed between an edge of the sealing plate in the open position and an internal surface of the skirt.

2. Device according to claim 1, wherein the sealing plate is located beyond an upper edge of the cylindrical sleeve.

3. Device according to claim 1, wherein the closure partition is slightly frustoconical with a concavity pointing towards the first container.

4. Device according to claim 1, wherein a cross-sectional area of an opening formed in the hoop is substantially equal to a cross-sectional area of the annular passage formed between the edge of the sealing plate in the open position and the internal surface of the cylindrical skirt, and is substantially equal to a cross-sectional area of the opening formed in the closure partition forming the seat.

5. Device according to claim 1, wherein the sealing plate is supported by at least two tabs extending substantially in an axial direction of the containers, these tabs being secured, at ends thereof remote from the sealing plate, to the hoop.

6. Device according to claim 5, wherein the sealing plate has a frustoconical edge able to interact with the seat which is correspondingly frustoconical.

7. Device according to claim 5, wherein the sealing plate is equipped, on an upper face thereof, with a projecting peripheral rib, whereas the closure partition is equipped, on a lower face thereof, with a groove having a cross-section that complements the rib, said rib being applied in a sealed manner into the groove through an axial translation movement.

8. Device according to claim 5, wherein the sealing piece is a separate piece which is fixed onto the neck of the first container.

9. Device according to claim 1, wherein the peripheral skirt of the sealing piece has a sealing lip to interact with an entrance of the neck, anti-rotation catches being provided between an internal face of the skirt and an external surface of the neck.

10. Device according to claim 1, wherein helical ramps and stubs are provided between the two containers to cause the relative translational displacement from a rotational movement.

11. Device according to claim 10, wherein the stubs are secured to the sealing piece and the helical ramps are secured to the second container.

12. Device according to claim 11, wherein the helical ramps are closed at ends thereof to prevent any detachment of the first and second containers due to an excessive rotational movement therebetween.

13. Device according to claim 11, wherein a means for stopping rotation is provided between the two containers, this stopping means comprising a longitudinal catch parallel to an axis of the two containers and provided on an internal surface of one of the first and second containers, this catch being able to interact with a corresponding longitudinal channel provided on the other of the first and second containers, when the assembly is in the closed position.

14. Device according to claim 5, wherein a screw flight system is provided between the first and second containers in order to cause the relative translational displacement from a rotational movement.

15. Device according to claim 5, wherein the hoop is provided directly on one of the containers and forms a single piece with said container.

16. Device according to claim 1, wherein the relative translational displacement between the two containers is by a single axial translation movement therebetween, the sealing piece is fixed to the neck of the first container and the hoop includes an internal edge which is secured to the cylindrical sleeve which is capable of displacement in a sliding fashion inside the cylindrical skirt secured to the partition formed on the second container.

17. Device for keeping two products separate from one another and for mixing them when desired, comprising:

a first container having a neck, and a second container having a removable cap, the first container receiving one of the products, and the second container receiving the other product;

a movable seal to isolate the first container from the second container, the seal including a skirt for surrounding the neck of the first container, a hoop extending radially inwards from the skirt, a cylindrical sleeve which extends from the hoop, and a sealing plate carried a distance from the hoop;

a closure partition connected to the second container, the partition including an opening-in a central region thereof forming a seat for the sealing plate, the closure partition including a cylindrical skirt extending downwards of the partition to interact with the cylindrical sleeve; and an annular passage formed between an edge of the sealing plate and an internal surface of the cylindrical skirt, wherein in a closed position, the sealing plate seals against the seat, whereas a relative translational displacement of the two containers moves the sealing plate away from the seat to open the sealing means, form the annular passage, and allow mixture of the two products.

18. Device according to claim 17, wherein the sealing plate is located beyond an upper edge of the cylindrical sleeve.

19. Device according to claim 17, wherein the closure partition is slightly frustoconical with a concavity pointing towards the first container.

20. Device according to claim 17, wherein a cross-sectional area of an opening formed in the hoop is substantially equal to a cross-sectional area of the annular passage formed between the edge of the sealing plate in the open position and the internal surface of the cylindrical skirt, and is substantially equal to a cross-sectional area of the opening formed in the closure partition forming the seat.

21. Device according to claim 17, wherein the sealing plate is supported by at least two tabs extending substantially in an axial direction of the containers, these tabs being secured, at ends thereof remote from the sealing plate, to the hoop.

22. Device according to claim 21, wherein the sealing plate has a frustoconical edge able to interact with the seat which is correspondingly frustoconical.

23. Device according to claim 21, wherein the sealing plate is equipped, on an upper face thereof, with a projecting peripheral rib, whereas the closure partition is equipped, on a lower face thereof, with a groove having a cross-section that complements the rib, said rib being applied in a sealed manner into the groove through the relative translational movement.

24. Device according to claim 17, wherein helical ramps and stubs are provided between the two containers to cause the relative translational displacement from a rotational movement.

25. Device according to claim 24, wherein the helical ramps are closed at ends thereof to prevent any detachment of the first and second containers due to an excessive rotational movement therebetween.

26. Device according to claim 17, wherein a stop to prevent rotation between the two containers is provided, this stop including a longitudinal catch parallel to an axis of the two containers and provided on an internal surface of one of the first and second containers, this catch being able to interact with a corresponding longitudinal channel provided on the other of the first and second containers, when the seal is in the closed position.

27. Device according to claim 17, wherein a screw flight system is provided between the first and second containers in order to cause the relative translational displacement from a rotational movement.

28. Device according to claim 17, wherein the hoop is provided directly on one of the containers and forms a single piece with said container.

29. Device according to claim 17, wherein the relative translational displacement between the two containers is by a single axial translation movement therebetween.

30. Device for keeping two products separate from one another and for mixing them when desired, comprising:

a first container having a neck, and a second container having a removable cap, the first container receiving one of the products, and the second container receiving the other product;

a sealing device to isolate the first container from the second container, the sealing device including a skirt surrounding the neck, a hoop extending radially inwards from the skirt, a cylindrical sleeve which extends upwardly from the hoop, and a sealing member spaced from the hoop; and a closure partition connected to the second container, the partition including an opening forming a seat for the sealing member, the closure partition including a cylindrical skirt extending downwards which interacts with the cylindrical sleeve, wherein in a closed position, the sealing member seals against the seat, whereas a movement of one of the containers relative to the other causes the sealing member to move away from the seat, form an annular passage between the sealing member and the seat, and allow mixture of the two products.

* * * * *